US006834710B2

(12) United States Patent
Weintraub et al.

(10) Patent No.: US 6,834,710 B2
(45) Date of Patent: Dec. 28, 2004

(54) PIVOT ASSEMBLY FOR BASEBOARD HEATER DAMPER

(75) Inventors: George Weintraub, Brooklyn, NY (US); Stephen Pulaski, Old Bethpage, NY (US)

(73) Assignee: Slant/Fin Corporation, Greenvale, NY (US)

( * ) Notice: Subject to any disclaimer, the term of this patent is extended or adjusted under 35 U.S.C. 154(b) by 0 days.

(21) Appl. No.: 10/173,134

(22) Filed: Jun. 17, 2002

(65) Prior Publication Data

US 2003/0230396 A1 Dec. 18, 2003

(51) Int. Cl.[7] ..... F24H 9/06
(52) U.S. Cl. ..... 165/55; 237/70
(58) Field of Search ..... 165/55, 96, 181, 165/182; 237/70

(56) References Cited

U.S. PATENT DOCUMENTS 4,010,348 A * 3/1977 Salinger ..... 165/55 X
4,086,468 A * 4/1978 Keldmann ..... 165/55 X
4,577,836 A * 3/1986 Guillemin
5,743,327 A * 4/1998 Villa ..... 165/76 X

* cited by examiner

*Primary Examiner*—Ljiljana Ciric
(74) *Attorney, Agent, or Firm*—Hubert Dubno

(57) ABSTRACT

A pivot assembly for the damper vane of a hot water baseboard heater. The pivot asembly has a base which slides into the channels of the damper vane and a projection which snaps into a hole on a respective support bracket of the baseboard. Fingers of the projection spread on one side of the bracket while a pair of resilient arms of the pivot assembly are braced against the other side of the bracket.

13 Claims, 6 Drawing Sheets

PIVOT ASSEMBLY FOR BASEBOARD HEATER DAMPER

FIELD OF THE INVENTION

The present invention relates to a pivot assembly for a baseboard heater damper vane, to a baseboard heater utilizing the improved pivot assembly and to an improved pivot element for use in such an assembly.

BACKGROUND OF THE INVENTION

A baseboard heater generally comprises an elongated housing having a heater element in the form of a tube or pipe which is traversed by hot water and is provided with an array of vanes by means of which heat is transferred to air entering the heater from below and emerging from the heater through a slot between the top of the housing and a front panel. The control of the flow of air by convection through the heater is effected by a damper vane overlying the heating element and generally located in the slot. That vane is pivotally mounted on a plurality of brackets spaced apart along the length of the heater housing.

The bracket itself is designed to hold the parts of the heater in place and to stiffen the housing and may also be formed with a seat carrying the heating element.

In the past the pivot connection between the damper vane or blade and the brackets utilized a riveted stud swinging through a slot in the bracket and a stitch in a member attached to the damper vane. Problems were encountered with assembly of the damper vane to the brackets in such systems and with operation of the damper.

OBJECTS OF THE INVENTION

It is, therefore, the principal object of the present invention to provide an improved pivot assembly for a baseboard heater damper which facilitates the mounting of the damper vane in the heater and the connection of the damper vane to the brackets.

Another object of the invention is to provide an improved baseboard heater which can be assembled more readily.

A further object of this invention is to provide a baseboard heater pivot assembly for a damper which eliminates drawbacks of prior art systems.

SUMMARY OF THE INVENTION

These objects and others which will become apparent hereinafter are attained, in accordance with the invention through the use of a molded pivot element which can be fitted into the damper vane and which can be snap fitted, in turn, into the bracket and which will pivotally mount the damper vane on the bracket.

According to a feature of the invention, the pivot assembly for a baseboard heater damper thus comprises:

a support bracket receivable in a housing of a baseboard heater and formed with a hole; and a molded pivot element engageable in a damper vane of the baseboard heater and formed with a tapered projection snap fitted through the hole and pivotally mounting the damper vane on the support bracket.

The baseboard heater can comprise:

an elongated housing;

a plurality of support brackets spaced apart along a length of the housing and lying in respective planes transverse to a longitudinal dimension of the housing, each of the brackets forming a seat at a lower portion thereof and a hole at an upper portion thereof;

an elongated heating element received in the housing and resting on the seats of the brackets, the heating element comprising a pipe extending substantially the length of the housing and a multiplicity of fins affixed to the pipe;

a damper vane extending substantially the length of the housing above the heating element; and respective molded pivot elements engaged in the damper vane and formed with respective tapered projections snap fitted through the holes of the respective brackets and pivotally mounting the damper vane on the support brackets.

The molded pivot element can comprise a base having a pair of opposite edges engageable in channels formed in opposite longitudinal edges of the damper vane, a web projecting from the base, and a tapered projection extending transversely from the web, the tapered projection having a plurality of angularly spaced resilient fingers diverging from a tip of the projection toward the web but terminating at a distance therefrom.

According to a feature of the invention the pivot element further comprises a central stem carrying the fingers, and a pair of opposite arms connected to the web at the stem and extending arcuately to respective free ends flanking the fingers, whereby the bracket is gripped between the fingers and the arms upon insertion of the projection into the hole, erecting friction between the mating parts.

The base can be generally rectangular and can have a body portion along one of the edges of the base forming a spring and frictionally retaining the pivot element against movement in the respective damper vane channel. The web of the molded pivot element can have a brace along a side of that web opposite the side of the web provided with the projection. The brace serves to stiffen the web. The projection, brace, web and base are formed in one piece and the base can be in the form of a frame surrounding an opening which can also be of rectangular configuration and can be adjacent the web. The edge of the base which is not formed as a spring, can be reinforced, i.e. formed with a rib receivable in the other channel of the damper vane. The invention is also applicable to steam and electric baseboard heaters.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
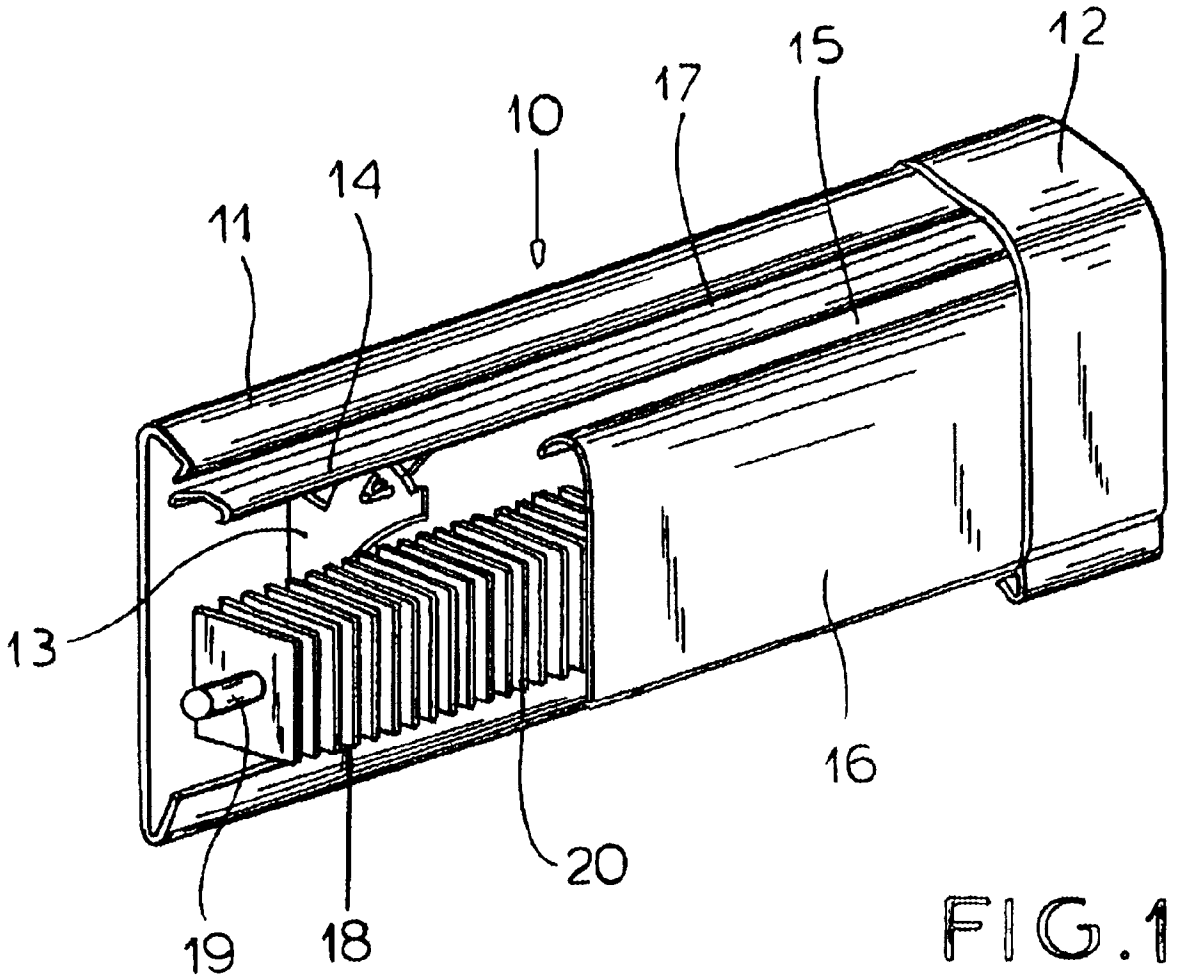
FIG. 1 is a diagrammatic perspective view of a portion of a baseboard heater utilizing the pivot assembly of the invention.

In FIG. 1, there is shown a baseboard heater 10 of the Base/Line 2000 hot water baseboard heater type marketed by SLANT/FIN and comprising a housing 11 which is formed with an end cap 12 and receives brackets 13 to which a damper vane 14 is pivotally connected by a pivot assembly as will be described in connection with FIGS. 2–5. The damper vane 14 is located in the slot 15 between the upper edge of a front panel 16 and an overhanging flange 17 of the housing. A heating element 18 is received on seats of the brackets 13, only one of which has been shown, and comprises a tube or pipe 19 on which fins 20 are provided. The tubing 19 can be copper tubing and the fins 20 can be aluminum and the heating element can have cradles supporting the heating element on each bracket.

Air passes into the heater below the panel 16 and emerges through the slot 15 after being heated in heat exchange with the hot water circulated through the tubing. The outflow of the air is controlled by tilting the damper vane 14 about the pivot axis formed by the pivots connecting that vane with the brackets.

Figure 2:
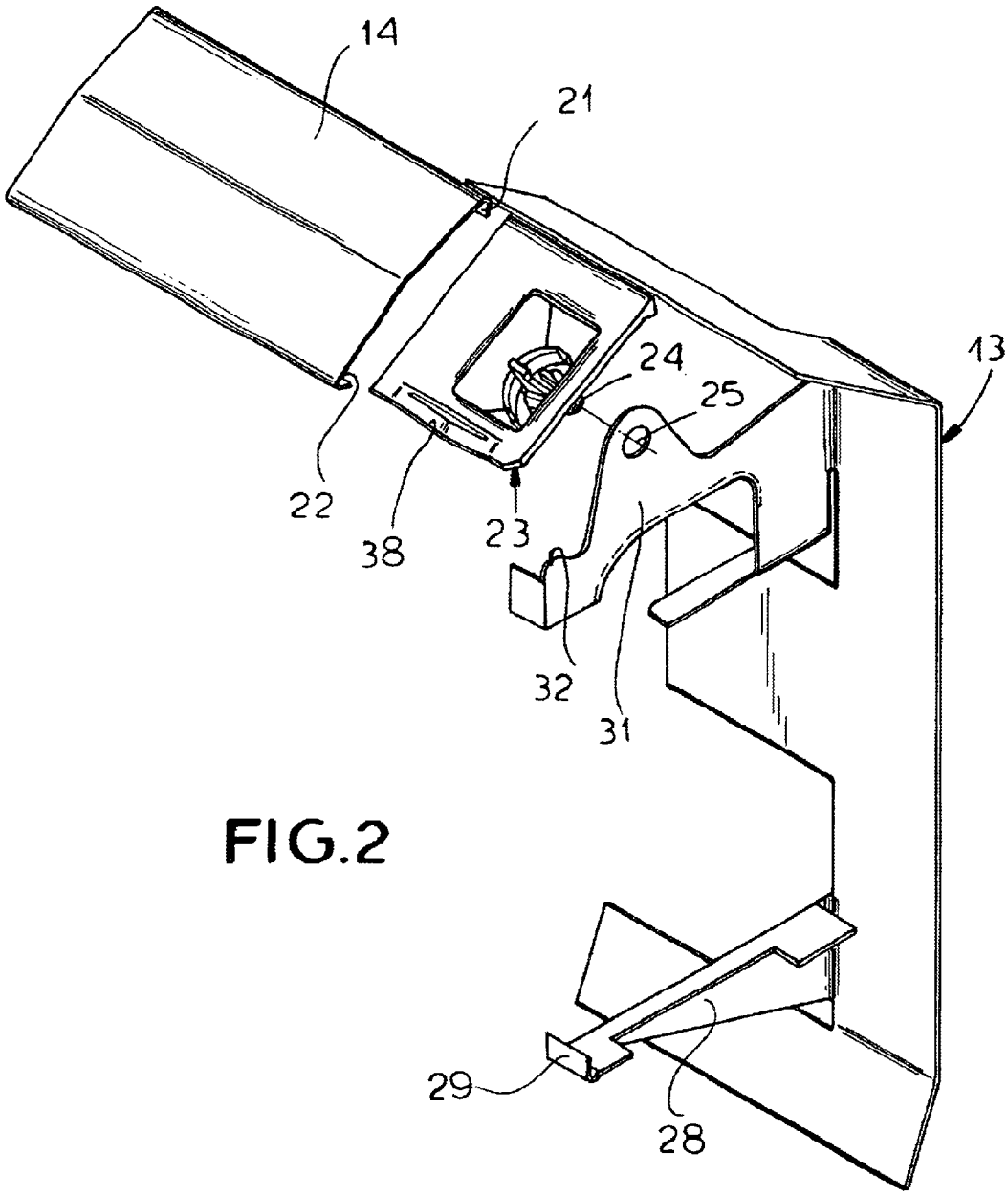
FIG. 2 is an exploded view of the pivot assembly.

From FIG. 2 it will be apparent that the damper vane 14 is formed along its longitudinal edges with a pair of channels 21 and 22 and can receive a plastic molded damper element 23 (see FIG. 4), e.g. of nylon 6 or nylon 6,6. The element 23 has a projection 24 snap fitted in a hole 25 in the bracket 13 previously described. The bracket 13 is shown in greater detail in FIG. 3.

Figure 3:
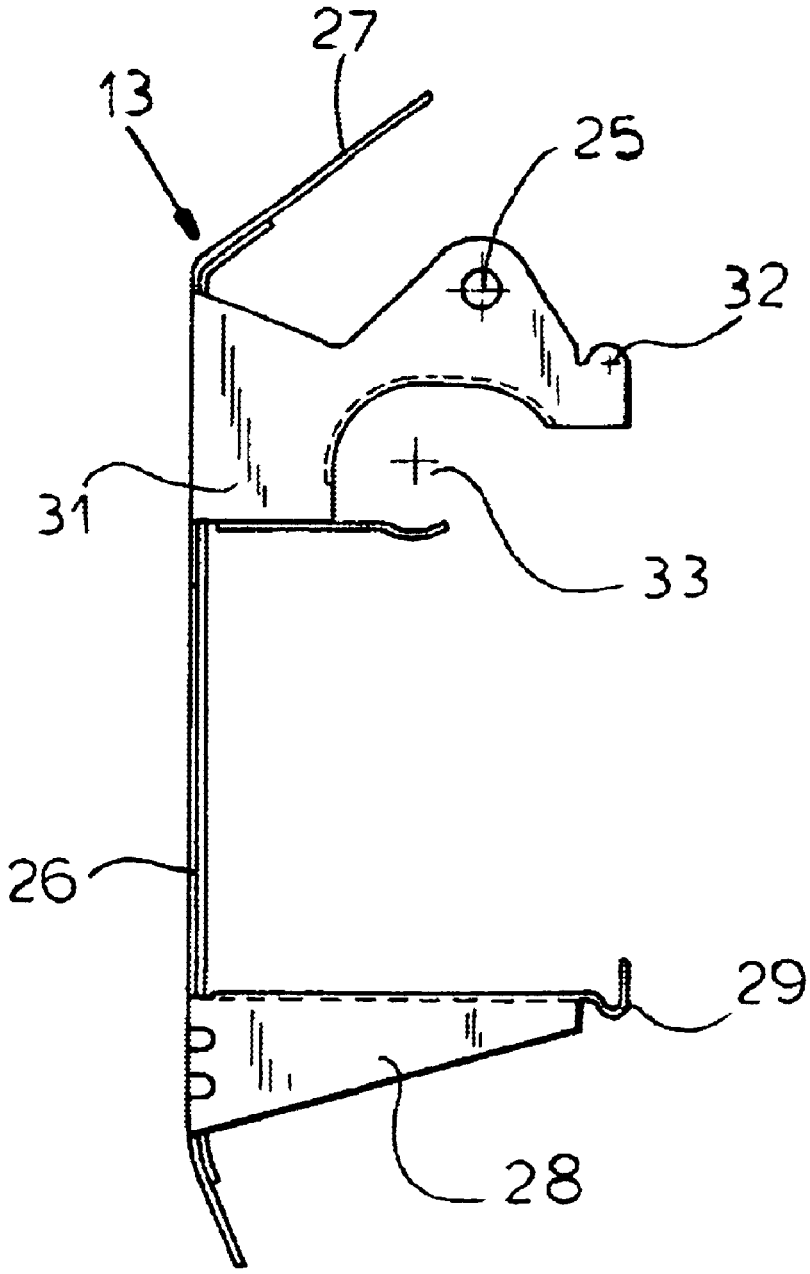
FIG. 3 is a side view of the bracket.

As can be seen from FIGS. 2 and 3, the bracket 13 is formed in one piece from sheet metal and has a rear member 26 lying along the housing wall and provided with a forwardly extending part 27 bracing the flange 17 of the housing portion 11 (FIG. 5) and another forwardly projecting portion 28 forming a seat for the heating element and having a bead 29 engageable by the lower edge 30 of the front panel 16 (FIG. 5) below the projecting portion 27. The bracket is provided with a forwardly projecting portion 31 which can have the aforementioned hole 25 and which lies in a plane perpendicular to the longitudinal design of the housing of the baseboard. The portion 31 is provided with a protuberance 32 engageable by the upper edge 33 of the front panel 16. A window 33 can be provided to accommodate a return pass of the tubing if desired.

Figure 4:
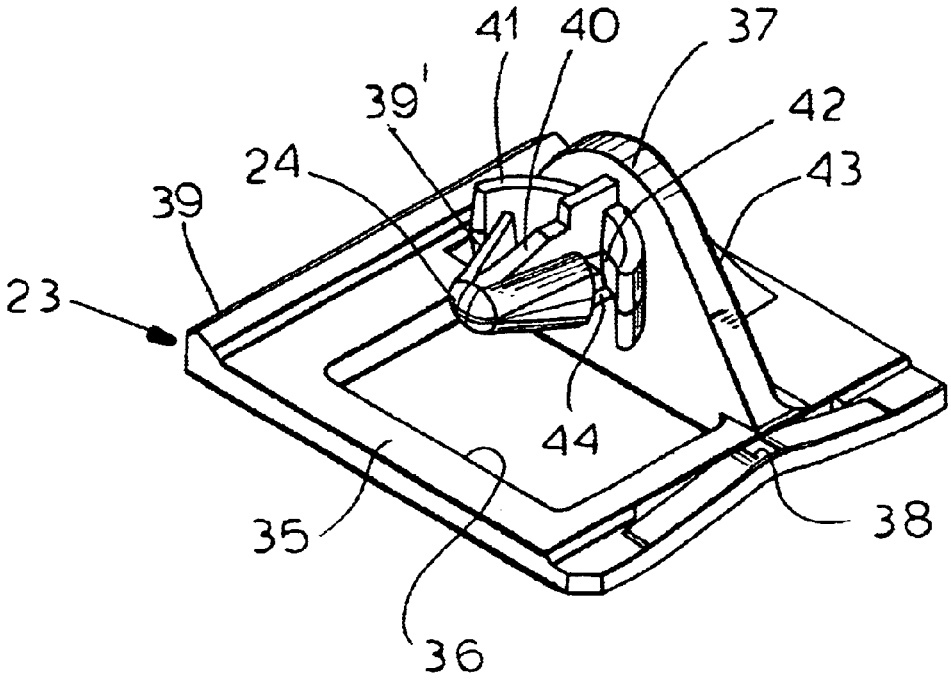
FIG. 4 is a perspective view of the molded pivot element.
Figure 5:
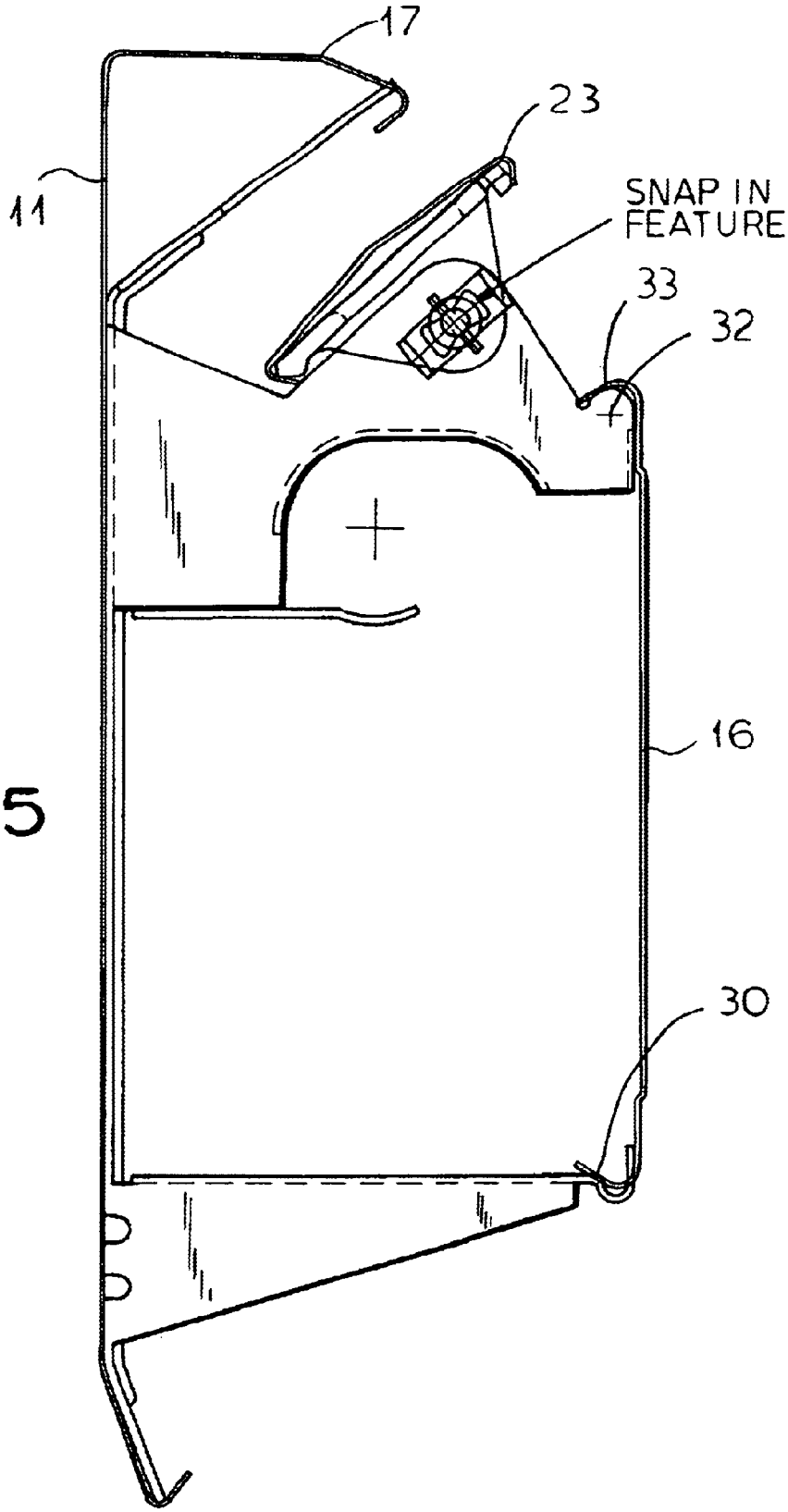
FIG. 5 is a side view of the bracket with the molded pivot element in place and parts of the baseboard housing in section, but omitting the heating element.

As can be seen from FIGS. 2 and 4, the pivot element 23 can be unitarily molded with a rectangular base 35 having a rectangular window 36 adjacent a triangular web 37 projecting perpendicularly to the plane of the base.

Along one edge of the base, a bend 38 is formed which is resilient and thus constitutes a spring forming a friction fit in the channel 22 of the damper vane. The other edge has a rib 39 receivable snugly in the other channel 21 of the damper vane.

Figure 6:
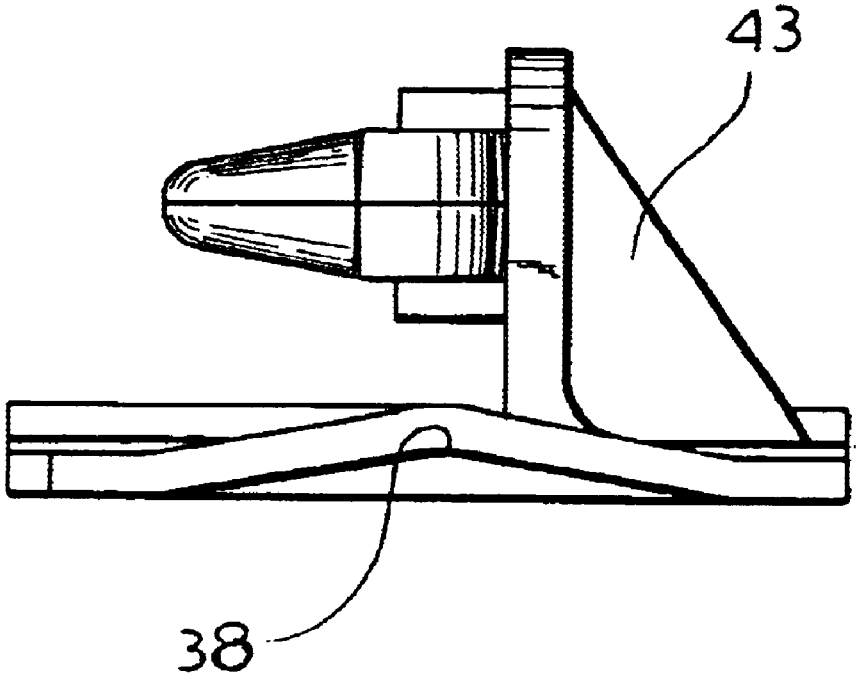
FIG. 6 is a side view of the pivot element.

The projection 24 from the web 37 has fingers 39 angularly equispaced on a stem 40, diverging toward the web 37 and having free edges spaced from the web so that the fingers, upon being pressed into the hole 25 are pressed toward one another until they clear the hole and then spring outwardly to retain the pivot element and thus the damper on the bracket 13 with freedom to rotate about the axis of the projection 24. So that the fingers 39 may bear on one side of the bracket and the pivot element may resiliently press on the other side of the bracket as well, two arcuate arms 41 and 42 extend outwardly from the stem 40 at its junction with the web 37. Small fingers 44 at the ends of the larger fingers 39 serve to center the pivot in the hole. The web 37 is braced at its rear by a triangular brace 43 (see FIGS. 4 and 6).

Thus once the molded pivot element 23 is inserted into the damper vane 14 it can be slid therealong so that its projection 24 can be snapped into the hole 25 and allow the damper vane to pivot smoothly.

We claim:

1. A baseboard heater which comprises:

a baseboard heater damper vane;

a support bracket receivable in a housing of the baseboard heater and formed with a hole; and a molded pivot element engaged with said damper vane of the baseboard heater, said pivot element being formed with a tapered projection snap fitted through said hole and pivotally mounting said damper vane on said support bracket, said pivot element comprising a base having a pair of opposite edges engageable in channels formed in opposite longitudinal edges of said damper vane, and a web projecting from said base, said tapered projection extending transversely from said web, said tapered projection having a plurality of angularly spaced resilient fingers diverging from a tip of said projection toward said web but terminating at a distance therefrom.

2. The baseboard heater defined in claim 1 wherein said pivot element further comprises a central stem carrying said fingers, and a pair of opposite arms connected to said web at said stem and extending arcuately to respective free ends flanking said fingers, whereby said bracket is gripped between said fingers and said arms upon insertion of said projection into said hole.

3. The baseboard heater defined in claim 2 wherein said base is generally rectangular and has a bowed portion along one of said edges of said base forming a spring and frictionally retaining said pivot element against movement in the respective channel.

4. The baseboard heater defined in claim 3 wherein said web has a brace along a side thereof opposite a side provided with said projection for stiffening said web.

5. The baseboard heater defined in claim 4 wherein said web, said projection, said brace and said base are formed in one piece.

6. The baseboard heater defined in claim 5 wherein the other of said edges of said base is formed with a rib receivable in the other channel of said damper vane.

7. A baseboard heater which comprises:

a baseboard heater damper vane;

a support bracket receivable in a housing of the baseboard heater and formed with a hole; and a molded pivot element engaged with said damper vane of the baseboard heater, said pivot element being formed with a tapered projection snap fitted through said hole and pivotally mounting said damper vane on said support bracket, the housing being an elongated housing;

a plurality of said support brackets being spaced apart along a length of said housing and lying in respective planes transverse to a longitudinal dimension of said housing, each of said brackets forming a seat at a lower portion thereof and a hole at an upper portion thereof;

an elongated heating element being received in said housing and resting on said seats of said brackets, said heating element comprising a pipe extending substantially the length of said housing and a multiplicity of fins affixed to said pipe;

said damper vane extending substantially the length of said housing above said heating element; and respective ones of said molded pivot elements being engaged in said damper vane and being formed with respective ones of said tapered projections snap fitted through said holes of the respective brackets and pivotally mounting said damper vane on said support brackets.

8. The baseboard heater defined in claim 7 wherein each said pivot element comprises a base having a pair of opposite edges engageable in channels formed in opposite longitudinal edges of said damper vane, a web projecting from said base, and said tapered projection extending transversely from said web, said tapered projection having a plurality of angularly spaced resilient fingers diverging from a tip of said projection toward said web but terminating at a distance therefrom.

9. The baseboard heater defined in claim 8 wherein each said pivot element further comprises a central stem carrying said fingers, and a pair of opposite arms connected to said web at said stem and extending arcuately to respective free ends flanking said fingers, whereby said bracket is gripped between said fingers and said arms upon insertion of said projection into said hole.

10. The baseboard heater defined in claim 9 wherein said base of each said pivot element is generally rectangular and has a bowed portion along one of said edges of said base forming a spring and frictionally retaining said pivot element against movement in the respective channel.

11. The baseboard heater defined in claim 10 wherein said web of each said pivot element has a brace along a side thereof opposite a side provided with said projection for stiffening said web.

12. The baseboard heater defined in claim 11 wherein said web, said projection, said brace and said base of each said pivot element are formed in one piece.

13. The baseboard heater defined in claim 12 wherein the other of said edges of said base of each said pivot element is formed with a rib receivable in the other channel of said damper vane.

* * * * *